United States Patent [19]

Wood

[11] Patent Number: 4,558,816

[45] Date of Patent: Dec. 17, 1985

[54] INTEGRAL CARRYING HANDLE FOR A CAN CARTON

[75] Inventor: Prentice J. Wood, Hapeville, Ga.

[73] Assignee: The Mead Corporation, Dayton, Ohio

[21] Appl. No.: 655,217

[22] Filed: Sep. 27, 1984

[51] Int. Cl.[4] ..... B65D 5/46

[52] U.S. Cl. ..... 229/52 B; 206/141; 206/427

[58] Field of Search ..... 229/40, 52 B; 206/427, 206/434, 141, 145–161

[56] References Cited

U.S. PATENT DOCUMENTS

| | | | |
|---|---|---|---|
| 2,407,919 | 9/1946 | Buttery | 221/48 |
| 2,598,051 | 5/1952 | Guyer et al. | 229/52 B |
| 2,718,301 | 9/1955 | Palmer | 206/427 |
| 2,785,847 | 3/1957 | Forrer | 206/427 |
| 3,750,874 | 8/1973 | Detzel et al. | 229/52 B |
| 3,807,624 | 4/1974 | Funkhouser | 229/40 |
| 4,405,078 | 9/1983 | Dutcher et al. | 206/434 |
| 4,470,503 | 9/1984 | Stone | 229/52 B |

FOREIGN PATENT DOCUMENTS

| | | | |
|---|---|---|---|
| 969461 | 10/1964 | Canada | 229/40 |
| 712902 | 7/1965 | Canada | 229/52 B |
| 843267 | 6/1970 | Canada | 229/52 B |
| 643350 | 9/1950 | United Kingdom | 206/390 |
| 1103372 | 2/1968 | United Kingdom | 206/141 |

*Primary Examiner*—William Price
*Assistant Examiner*—Gary E. Elkins
*Attorney, Agent, or Firm*—Rodgers & Rodgers

[57] ABSTRACT

A can carton having interconnected top, bottom and side walls and end closure panels is provided with a perforated transverse slit extending completely across one carton wall and having end projections disposed in substantially perpendicular relation to the one carton wall and extending into the two carton walls interconnected therewith together with a pair of transverse handle flaps struck from the one carton wall and foldably joined respectively thereto by transverse fold lines generally parallel to the transverse slit and spaced therefrom on opposite sides by a distance approximately equal to one-half the length of each of the end projections.

16 Claims, 4 Drawing Figures

INTEGRAL CARRYING HANDLE FOR A CAN CARTON

TECHNICAL FIELD

This invention relates generally to can cartons and more particularly to carrying handles for such cartons.

BACKGROUND ART

British Pat. No. 1,602,857 discloses a can carton in which a carrying handle is incorporated, the handle panel being formed of two parts and wherein a slit extends into both side walls of the carrier at an acute angle to the carrier top wall

DISCLOSURE OF THE INVENTION

According to this invention in one form, a can carton having interconnected top, bottom and side walls and end closure panels is provided with a carrying handle defined by a perforated transverse slit extending completely across one carton wall and having end projections disposed in substantially perpendicular relation to said one carton wall and extending into the two carton walls interconnected therewith by a distance which is dependent on the diameter of the packaged cans to define one edge of a transverse handle flap struck from said one carton wall and foldably joined thereto by a transverse fold line generally parallel to said transverse perforated slit and spaced therefrom a distance approximately equal to one-half the length of each of said end projections.

According to a feature of the invention, the spacing between the transverse perforated slit and the handle flap fold line is approximately one-third of the radius of the packaged cans thereby to accommodate folding of the handle flaps through approximately 180° into flat face contacting relation with the inner surface of said one carton wall.

According to another form of the invention a pair of identical transverse complementary handle flaps may be employed and arranged on opposite sides of the transverse perforated slit.

BEST MODE OF CARRYING OUT THE INVENTION

Figure 1:
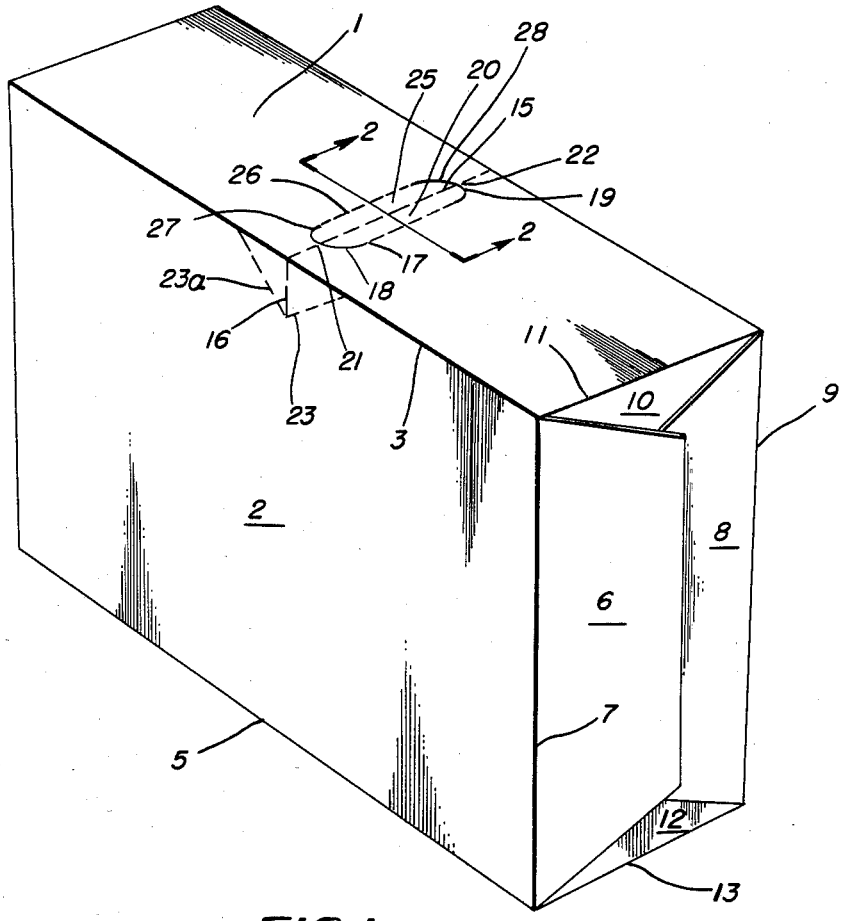
FIG. 1 is a perspective view of a loaded set-up can carton which embodies the handle structure of this invention.
Figure 4:
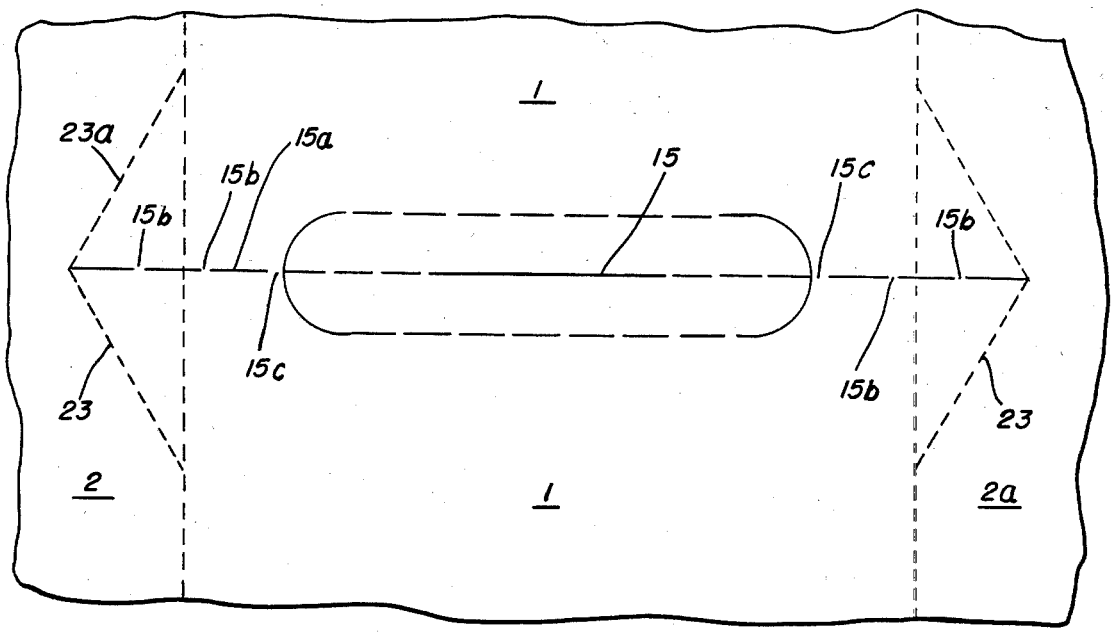
FIG. 4 is an enlarged part of a portion of a blank from which the carton is formed.
Figure 2:
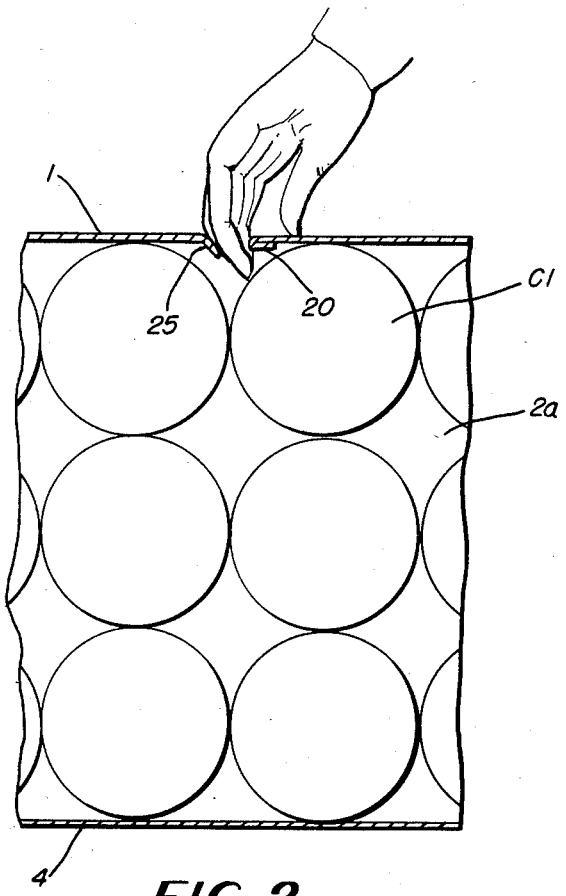
FIG. 2 is a cross sectional view taken along the lines designated 2—2 in FIG. 1.

With reference to FIG. 1 the can carton includes a main wall designated by the numeral 1 to which a side wall designated by the numeral 2 is foldably joined along fold line 3. A bottom wall 4 as shown in FIG. 2 is foldably joined to side wall 2 along fold line 5 and to a side wall 2*a* opposite from side wall 2 which is not observable in FIG. 1, a fragment of which appears in FIG. 4.

The closure panels for both ends of the carton are identical. As is apparent from FIGS. 1 and 3 panel 6 is foldably joined to the side wall 2 along a fold line 7 while panel 8 is foldably joined along a fold line 9 to the side wall opposite from that designated by the numeral 2. End flap 10 is foldably joined to carton wall 1 along fold line 11 while end flap 12 is foldably joined to the bottom wall 4 along fold line 13. Flaps 6, 8, 10 and 13 are secured in overlapping relation as shown in FIG. 1 and secured by known means to form an end closure for the carton.

Figure 3:
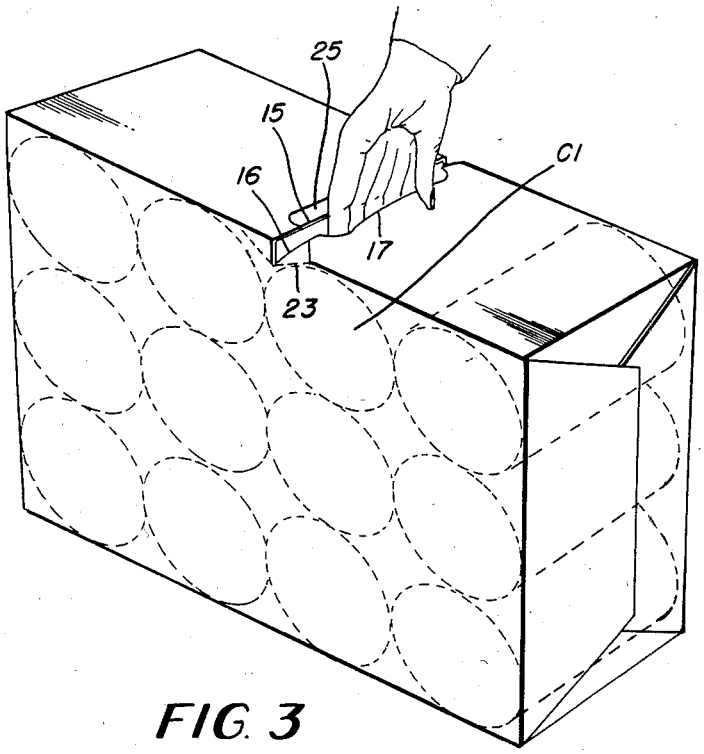
FIG. 3 is a view similar in some respects to FIG. 1 but which shows the carton in lifted condition and depicts the function of the handle flap and of parts associated therewith.

As is apparent from FIG. 3, three rows of four cans each are disposed within the carton and arranged with their axes in parallel relation to each other.

With reference to FIG. 1, a transverse perforated slit 15 is formed in top wall 1 and extends completely across that wall. In addition this perforated slit includes end projections which extend downwardly into side wall 2 and also into the opposite side wall not observable in FIG. 1, the end projection formed in side wall 2 being designated by the numeral 16. Since slits 15 and 16 include imperforate portions, the carton components adjacent these slits are held together to provide strength and an uninterrupted area to which attractive graphics may be applied. A fold line 17 is formed in carton wall 1 and a pair of arcuate slits 18 and 19 interconnect the ends of fold line 17 with the transverse perforated fold line 15 to define a handle flap generally designated by the numeral 20.

The point of intersection of arcuate slit 18 with transverse perforated slit 15 is designated by the numeral 21 while the point of intersection between arcuate slit 19 and transverse perforated slit 15 is designated by the numeral 22. According to one feature of this invention, the spacing between fold line 17 and transverse perforated slit 15, i.e., the width of handle flap 20 is equal approximately to one-half the distance between point 21 and fold line 3. In addition the length of projection 16 is approximately equal to the spacing between point of intersection 21 and fold line 3. While the particular distance between point 21 and fold line 3 is not critical, it is preferable that this spacing be not less than twice the spacing between perforated slit 15 and fold line 17 in order to provide mechanical strength and to facilitate the function of handle flap 20. In like fashion corresponding structure at the other end of the handle flap 20 is similarly constructed.

A fold line 23 is formed in side wall 2 and a similar fold line not observable in the drawings is shown in the side wall which is opposite the side wall 2.

Disposed adjacent the flap 20 is a similar handle flap 25 one edge of which is defined by transverse perforated slit 15 while a fold line 26 interconnects handle flap 25 with carton wall 1 and arcuate slits 27 and 28 are formed at the ends of the handle flap 25 and correspond generally to arcuate slits 18 and 19.

The transverse perforated fold line 15 is formed of a plurality of perforations such as are indicated at 15*a* which are interspersed between imperforate portions 15*b*. According to one feature of the invention, the imperforate portions 15*c* which are disposed immediately adjacent the arcuate slits 18, 19, 27 and 28 are approximately twice as long as the remaining imperforate portions such as 15*b*. These longer imperforate portions 15*c* have been constructed in a practical embodiment of the invention and are one-eighth of an inch in length while other imperforate portions such as 15*b* are approximately one-sixteenth inch in length.

While the fold lines 17 and 26 are shown as formed by perforated fold lines similar to perforated transverse slit 15, it will be understood that these fold lines could simply constitute somewhat weakened areas formed in conventional fashion such as the weakened fold line 23 or its counterpart 23*a*.

In using the handle flap of this invention to lift and carry the carton, the fingers of a user are inserted against the flap such as 20 as shown in FIG. 2. This operation causes the flap 20 to swing inwardly about its fold line 17 through an angle of approximately 180° to occupy a position of flat face contacting relation with the inner surface of a carton wall 1 as shown in FIG. 2. By this structure flap 20 effectively reinforces top or main wall 1 and affords a cushion along fold line 17 which protects the hand of the user. This operation may be accompanied by a downward bending of flap 25 so as to facilitate entry of the user's fingers into a position whereby folding of flap 20 may be effected.

Lifting of the carton causes an inward bending of the triangular structure defined by slit 16 fold line 23 and fold line 3 inwardly against the end of an associated can as represented in FIG. 3. This folding operation results in a distribution of the load over a wide area of the carton side wall. Preferably the fold line 23 is disposed approximately tangentially with respect to the end of the adjacent can C1.

In order to provide clearance for the carrying flap 20 to swing inwardly past the adjacent can C1, the width of handle flap 15, i.e., the distance between fold line 17 and transverse perforated slit 15 is approximately one-third of the radius of the adjacent can such as C1. This relationship of parts allows inward swinging of the flap 20 and accommodates easy clearance between that flap and the can C1. Preferably the transverse perforated slit 15 should be disposed midway between the ends of the the carrier. Also the flap 25 may be used in order to lift and carry the carrier as well as the flap 20. The operation of carrying flap 25 is identical to the operation of carrying flap 20 as is obvious.

The provision of two identical centrally located carrying flaps and associated structure makes possible the lifting of the carton using either flap as a lifting element and frees the user from the necessity of determining precisely how to insert his fingers, i.e., a choice of flaps is provided.

INDUSTRIAL APPLICABILITY

By this invention an efficient and strong carrying handle for a can carton is provided while the arrangement of the handle structure is such as to preserve the mechanical strength and integrity of the carton walls whereby effective can retention is achieved.

I claim:

1. A carrying handle for a carton for packaging a plurality of cans and having interconnected top, bottom, and side walls and end closure panels, said handle comprising a perforated transverse slit extending completely across one of said interconnected carton walls and having end projections disposed in substantially perpendicular relation to said one of said interconnected carton walls and extending into the two carton walls interconnected therewith, a transverse handle flap struck from said one of said interconnected carton walls and foldably joined thereto by a transverse fold line generally parallel to said transverse slit and spaced therefrom, and a second transverse handle flap struck from said one of said interconnected carton walls and foldably joined thereto by a transverse fold line generally parallel to and spaced from said perforated transverse slit, said perforated transverse slit defining coincidental transverse edges of both of said handle flaps.

2. A carrying handle according to claim 1 wherein the distance between each of said transverse fold lines and said transverse slit is approximately equal to one-half the length of each of said end projections.

3. A carrying handle according to claim 1 wherein the ends of each of said transverse handle flaps are defined respectively by a pair of end slits which extend between said perforated transverse slit and the ends of said transverse fold line respectively.

4. A carrying handle according to claim 3 wherein each of said end slits is of arcuate configuration.

5. A carrying handle according to claim 3 wherein the distance separating each of the junctions between each of said end slits and said perforated transverse slit and the adjacent edges of said one wall are approximately equal to the associated end projections.

6. A carrying handle for a can package according to claim 1 wherein the axes of said plurality of cans are generally parallel to each other and to said perforated transverse slit.

7. A carrying handle according to claim 1 wherein said transverse fold line is perforated.

8. A carrying handle according to claim 1 wherein imperforate parts of said perforated transverse slit which are disposed immediately adjacent and outward of the ends of said transverse handle flap are of substantially greater length than other imperforate parts of said perforated transverse slit.

9. A carrying handle according to claim 1 wherein said transverse handle flaps are foldable inwardly through an angle of approximately 180 degrees into face contacting relation with the inner surface of said one of said interconnected carton walls.

10. A carrying handle according to claim 1 wherein a pair of fold lines are formed in each of the carton walls which are interconnected with said one of said interconnected carton walls, each of said fold lines extending from the extremity of the associated end projection to the adjacent carton corner between said one of said interconnected carton walls and each wall interconnected therewith.

11. A carrying handle according to claim 10 wherein each of said fold lines is disposed in substantialy tangential relation with the end of an adjacent can disposed within the carton.

12. A carrying handle according to claim 1 wherein the distance between each of said transverse fold lines and said perforated transverse slit is approximately one-third of the radius of the packaged cans.

13. A carrying handle for a can carton for packaging a plurality of cans and having interconnected top, bottom, and side walls and end closure panels, said handle comprising a perforated transverse slit extending completely across one of said interconnected carton walls and having end projections disposed in substantially perpendicular relation to said one of said interconnected carton walls and extending into the two carton walls interconnected therewith by a distance which is dependent upon the diameter of each of said plurality of cans, and a pair of complementary substantially identical transverse handle flaps struck from said one carton wall and foldably joined thereto by a pair of transverse fold lines on opposite sides of said perforated transverse slit, said pair of transverse fold lines being generally parallel to said transverse slit and each of said parallel fold lines being spaced therefrom a distance approximately equal to one-half the length of each of said end projections.

14. A can carton blank comprising a plurality of interconnected walls including a main wall panel, an end closure panel foldably joined to each end of each of said interconnected walls and a transverse handle flap defined by a perforated transverse slit extending completely across said main panel and having end projections extending into the two carton walls interconnected therewith, a transverse fold line formed in said main panel and extending partially thereacross and in spaced relation to said perforated transverse slit, a pair of end slits interconnecting the ends of said fold line respectively with said perforated transverse slit, and a fold line extending between the extremity of each of said end projections and the side edge of said main panel, the length of said end projections being approximately twice the distance between said transverse perforated slit and said transverse fold line.

15. A can carton blank according to claim 14 wherein the distance between the point of intersection of each of said end slits and said transverse perforated slit and the adjacent edge of said main panel is approximately equal to the length of the associated end projection.

16. A carrying handle for a carton for packaging a plurality of cans and having interconnected top, bottom, and side walls and end closure panels, said handle comprising a perforated transverse slit extending completely across one of said interconnected carton walls and having end projections disposed in substantially perpendicular relation to said one of said interconnected carton walls and extending into the two carton walls interconnected therewith by a distance which is dependent upon the diameter of each of said plurality of cans, and a transverse handle flap struck from said one of said interconnected carton walls and foldably joined thereto by a transverse fold line generally parallel to said transverse slit and spaced therefrom a distance approximately equal to one-half the length of each of said end projections, the edge of said transverse handle flap which is remote from said transverse fold line being defined by said perforated transverse slit and the ends of said transverse handle flap being defined respectively by a pair of end slits which extend between points on said perforated transverse slit and the ends of said transverse fold line respectively which points are spaced from the adjacent edges of said one wall.

* * * * *